US011031724B2

(12) United States Patent
Hiei et al.

(10) Patent No.: US 11,031,724 B2
(45) Date of Patent: Jun. 8, 2021

(54) STACKED CONNECTOR AND WIRE HARNESS

(71) Applicant: Sumitomo Wiring Systems, Ltd., Mie (JP)

(72) Inventors: Susumu Hiei, Mie (JP); Kenta Itou, Mie (JP); Takehiro Nakata, Mie (JP); Kohei Yamaguchi, Mie (JP); Yuichi Nakamura, Mie (JP); Daisuke Fukai, Mie (JP); Masaki Mizushita, Mie (JP); Motohiro Yokoi, Mie (JP); Kohei Takagi, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/490,719

(22) PCT Filed: Mar. 9, 2017

(86) PCT No.: PCT/JP2017/009602
§ 371 (c)(1),
(2) Date: Sep. 3, 2019

(87) PCT Pub. No.: WO2018/163382
PCT Pub. Date: Sep. 13, 2018

(65) Prior Publication Data

US 2020/0006885 A1 Jan. 2, 2020

(51) Int. Cl.
*H01R 13/514* (2006.01)
*H01R 13/42* (2006.01)
*H01R 31/08* (2006.01)

(52) U.S. Cl.
CPC ..... *H01R 13/514* (2013.01); *H01R 13/42* (2013.01); *H01R 31/08* (2013.01)

(58) Field of Classification Search
CPC ..... H01R 13/514; H01R 13/434; H01R 31/08
(Continued)

(56) References Cited

U.S. PATENT DOCUMENTS 5,288,251 A * 2/1994 Sumida ..... H01R 13/514 439/701
5,320,555 A * 6/1994 Okabe ..... H01R 13/6272 439/354

(Continued)

FOREIGN PATENT DOCUMENTS

JP 06-181078 A 6/1994
JP 2013-232324 A 11/2013
JP 2014-049399 A 3/2014

OTHER PUBLICATIONS

International Search Report dated May 30, 2017 for WO 2018/163382 A1.

*Primary Examiner* — Abdullah A Riyami
*Assistant Examiner* — Marcus E Harcum
(74) *Attorney, Agent, or Firm* — Abelman, Frayne & Schwab

(57) ABSTRACT

An object is to provide a technique by which a space in a vehicle in which a wire harness including a plurality of splice circuits is arranged can be reduced and good manufacturability at the time of manufacture can be achieved. A stacked connector is formed by joining a plurality of split connectors to each other. The split connectors each include a split connector housing provided with a plurality of terminal receiving chambers and a plurality of terminal-equipped electric wires that each include a terminal received in the terminal receiving chamber and an electric wire to which the terminal is connected. At least one of the split connector housings is provided with a locking portion having a protruding shape that protrudes outward to be capable of locking the terminal-equipped electric wire
(Continued)

received in the split connector housing of a joining counterpart.

4 Claims, 13 Drawing Sheets

(58) Field of Classification Search
USPC ..... 439/752, 717
See application file for complete search history.

(56) References Cited

U.S. PATENT DOCUMENTS 5,643,015 A * 7/1997 Wakata ..... H01R 13/4361 439/701
6,007,386 A * 12/1999 Okabe ..... H01R 13/42 439/701
6,332,811 B1 * 12/2001 Sato ..... H01R 13/506 439/497
6,402,568 B1 * 6/2002 Nagai ..... H01R 13/506 439/701
6,488,546 B2 * 12/2002 Sakurai ..... H01R 13/514 439/701
6,851,985 B2 * 2/2005 Lafragette ..... H02B 1/26 439/701
7,297,032 B2 * 11/2007 Kobayashi ..... H01R 13/4361 439/595
7,572,154 B2 * 8/2009 Ichio ..... H01R 13/4361 361/735
7,695,315 B2 * 4/2010 Hitchcock ..... H01R 13/4223 439/541.5
8,747,168 B2 * 6/2014 Kida ..... H01R 13/506 439/701
8,915,758 B2 * 12/2014 Shishikura ..... H01R 13/506 439/701
9,673,560 B2 * 6/2017 Lihoshi ..... H01R 13/514
9,722,341 B2 * 8/2017 Chikusa ..... H01R 13/4223
10,205,264 B2 * 2/2019 Washio ..... H01R 13/42
10,498,068 B2 * 12/2019 Takagi ..... H01R 13/502
2001/0053631 A1 * 12/2001 Nagai ..... H01R 4/2433 439/625
2002/0115355 A1 * 8/2002 Yoshida ..... H01R 13/514 439/701
2002/0197893 A1 * 12/2002 Hiroyuki ..... H05K 7/026 439/76.2
2003/0236032 A1 * 12/2003 Sakatani ..... H01R 13/64 439/677
2004/0158982 A1 * 8/2004 Saitoh ..... H01R 4/2466 29/884
2007/0141905 A1 * 6/2007 Takeda ..... H01R 13/6273 439/594
2010/0136842 A1 * 6/2010 Sakamoto ..... H01R 13/521 439/639
2012/0225576 A1 * 9/2012 Kida ..... H01R 13/641 439/345
2016/0365665 A1 * 12/2016 Chikusa ..... H01R 24/28

* cited by examiner

STACKED CONNECTOR AND WIRE HARNESS

CROSS REFERENCE TO RELATED APPLICATIONS

This application is a national phase of PCT application No. PCT/JP2017/009602, filed on 9 Mar. 2017, which is incorporated herein in its entirety by reference.

TECHNICAL FIELD

The present invention relates to a short circuit in a wire harness.

BACKGROUND

Conventionally, a joint connector is known as a means for forming a short circuit (also referred to as a splice circuit) for shorting a plurality of electric wires included in a wire harness or the like of an automobile. Such a joint connector is disclosed in Patent Document 1, for example.

The joint connector disclosed in Patent Document 1 includes an insulating housing and a bus bar that is provided in the insulating housing and connects a plurality of male terminals. The insulating housing is provided with a plurality of terminal receiving chambers and one housing fitting portion. The terminal receiving chambers are each capable of receiving a first female terminal connected to an end portion of an electric wire. The housing fitting portion is capable of receiving a female connector provided with a plurality of terminal-equipped electric wires to which second female terminals are connected. The plurality of female terminals are shorted via the bus bar.

PRIOR ART DOCUMENT

Patent Document

Patent Document 1: JP 2014-049399A

SUMMARY OF THE INVENTION

Problems to be Solved

Here, in recent years, the number of splice circuits described above has been on the rise following an increase in the number of circuits in a vehicle. Thus, if the number of joint connectors is increased, accordingly, the installation space increases, and because there is a limit on space in the vehicle in which the wire harness can be arranged, there is a demand for a decrease in the space used for arrangement from the viewpoint of arrangement in the vehicle. It is conceivable to, as a means for realizing a decrease in the space used for arrangement, increase the number of poles in one joint connector and make them more concentrated.

On the other hand, from the viewpoint of manufacturing a wire harness, wire harnesses are more easy to manufacture when the connectors are dispersed during a manufacturing process, and thus dispersion is desired during the manufacturing process.

In view of this, an object of the present invention is to provide a technique by which a space in a vehicle where a wire harness including a plurality of splice circuits is arranged can be reduced, and good manufacturability at the time of manufacture can be achieved.

Means to Solve the Problem

In order to resolve the above-described issues, a stacked connector according to a first aspect is a stacked connector formed by joining a plurality of split connectors to each other, in which the split connectors each include a split connector housing provided with a plurality of terminal receiving chambers, and a plurality of terminal-equipped electric wires that each include a terminal received in the terminal receiving chamber, and an electric wire to which the terminal is connected, and at least one of the split connector housings is provided with a locking portion having a protruding shape that protrudes outward to be capable of locking the terminal-equipped electric wire received in the split connector housing of a joining counterpart.

A stacked connector according to a second aspect is the stacked connector according to the first aspect, in which the split connectors are stacked in three or more layers, and two surfaces of at least one of the split connector housings located at an intermediate position in a stacking direction are provided with the locking portions.

A stacked connector according to a third aspect is the stacked connector according to the first or second aspect, in which a pair of the split connectors that are adjacent to each other include a pair of split connectors that are provided with the locking portions that are capable of locking the terminal-equipped electric wires received in the counterpart split connector housing, and through holes for receiving the counterpart locking portions, the locking portions and the through holes being located in an alternating manner in a direction intersecting the stacking direction.

A wire harness according to a fourth aspect includes the stacked connector according to any one of the first to third aspects, and a joint connector that includes a joint terminal provided with a linking piece and a plurality of tab terminals protruding in parallel to each other from the linking piece, and a joint connector housing in which the joint terminal is housed and by which the joint terminal is supported, the joint connector being capable of being fitted to the stacked connector.

A wire harness according to a fifth aspect is the wire harness according to the fourth aspect, in which a plurality of the stacked connectors are connected to the one joint connector, and the split connector housing located in one surface layer of each of the plurality of stacked connectors is provided with erroneous fitting restricting ribs having different shapes.

A wire harness according to a sixth aspect is the wire harness according to the fifth aspect, in which the split connector housings located in layers other than the one surface layer of each of the plurality of stacked connectors are formed in the same shape.

A wire harness according to a seventh aspect is the wire harness according to any one of the fourth to sixth aspects, in which a plurality of the stacked connectors are connected side-by-side to the one joint connector from one side, and the joint connector housing is capable of receiving, in one receiving space, connector housings of a plurality of the stacked connectors to be connected to the joint connector housing from one side.

A wire harness according to an eighth aspect is the wire harness according to the seventh aspect, in which a plurality of the stacked connectors are connected to the one joint connector from one side, and a plurality of the stacked connectors are connected to the one joint connector from another side.

Effect of the Invention

According to the first to third aspects, as a result of having a split form, the connectors can be dispersed at the time of manufacture. Also, as a result of having a stacked form, the connectors can be concentrated at the time of arrangement in a vehicle. At this time, the locking portion is capable of locking the terminal-equipped electric wire received in a joining counterpart, and thus it is possible to reduce the size of the stacked connector. Accordingly, it is possible to reduce a space in a vehicle in which a wire harness including a plurality of splice circuits is arranged and achieve good manufacturability at the time of manufacture.

In particular, according to the second aspect, even if split connector housings are stacked in three or more layers, terminal-equipped electric wires of each layer can be locked by the locking portions.

In particular, according to the third aspect, terminal-equipped electric wires of two counterpart split connectors can be locked by the locking portions.

According to the fourth to eighth aspects, as a result of the stacked connector having a split form, the connectors can be dispersed at the time of manufacture. Also, as a result of the stacked connector having a stacked form, the connectors can be concentrated at the time of arrangement in a vehicle. At this time, the locking portion is capable of locking the terminal-equipped electric wire received in a joining counterpart, and thus it is possible to reduce the size of the stacked connector. Accordingly, it is possible to reduce a space in a vehicle in which a wire harness including a plurality of splice circuits is arranged and achieve good manufacturability at the time of manufacture.

In particular, according to the fifth aspect, it is possible to suppress erroneous fitting between the joint connector and the plurality of stacked connectors.

In particular, according to the sixth aspect, it is possible to suppress an increase in the number of types of components.

In particular, according to the seventh aspect, it is possible to suppress a decrease in the number of connectors while making them more concentrated. At this time, the connector housings of the plurality of stacked connectors connected from one side are received in one receiving space. Thus, walls for partitioning the plurality of stacked connectors are omitted, and thus it is possible to reduce the external size of the joint connector housing.

In particular, according to the eighth aspect, it is possible to suppress a decrease in the number of connectors while making connectors more concentrated.

DETAILED DESCRIPTION TO EXECUTE THE INVENTION

Embodiments

Figure 1:
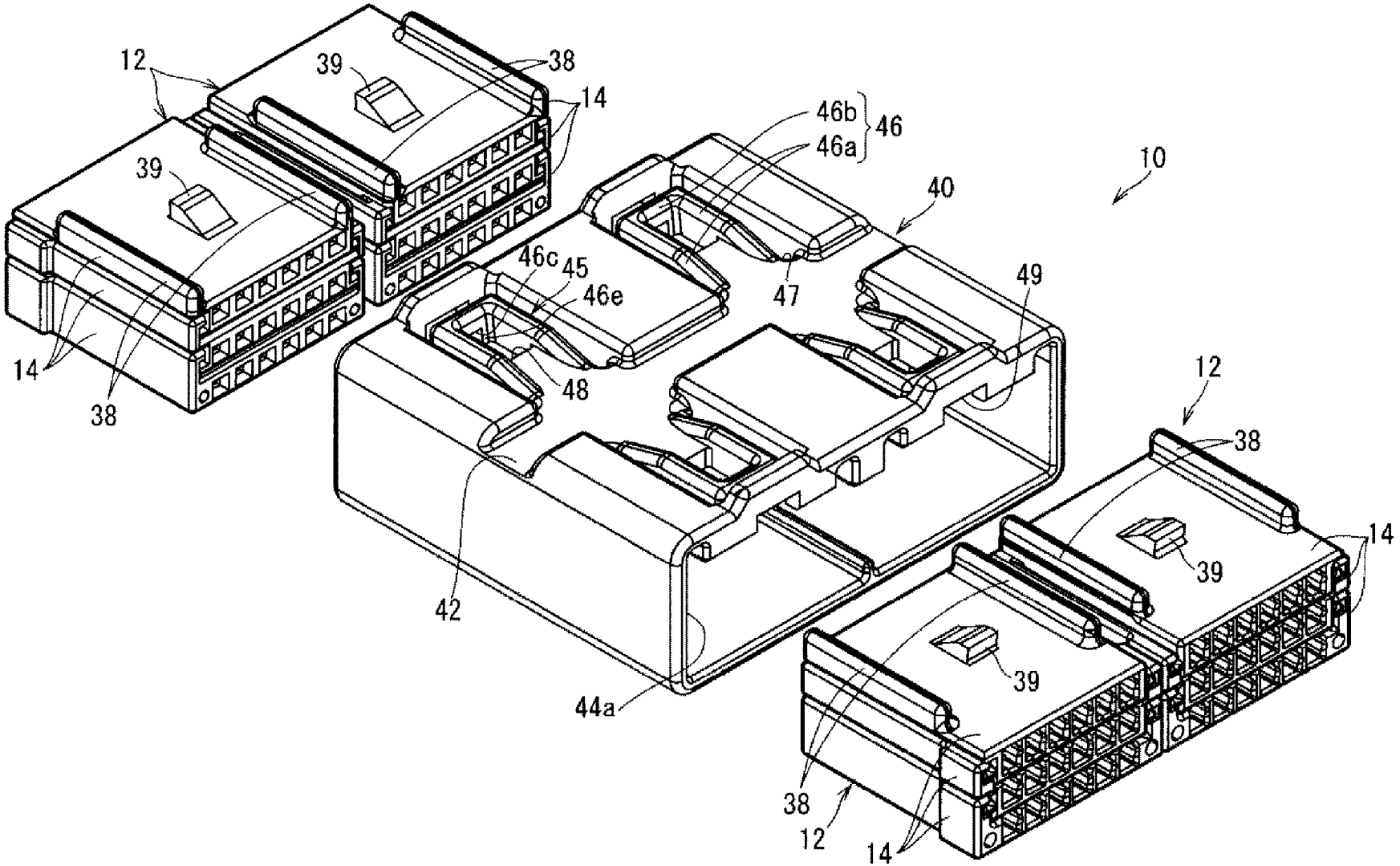
FIG. 1 is an exploded perspective view showing a wire harness according to an embodiment.
Figure 2:
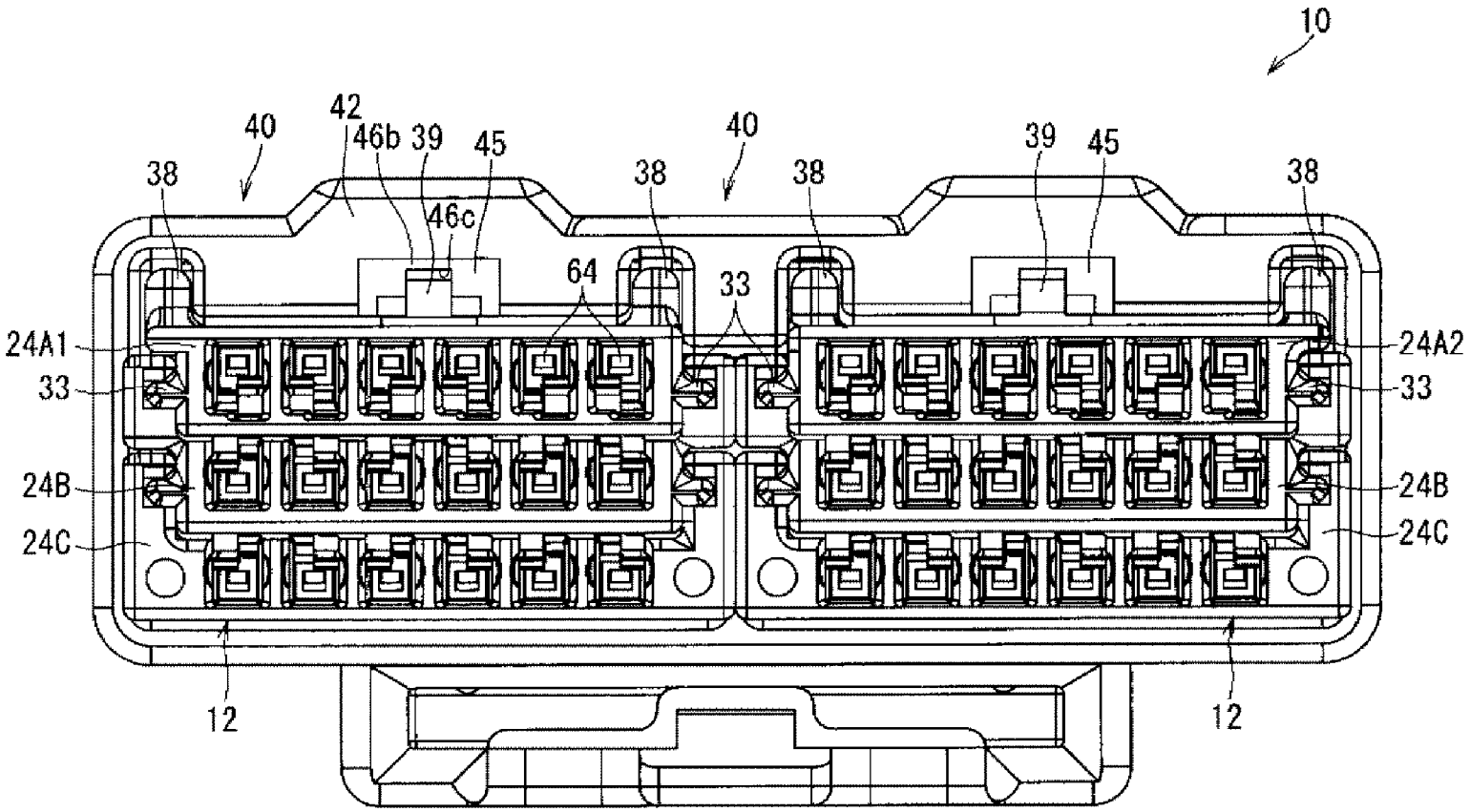
FIG. 2 is a front view showing the wire harness according to the embodiment.

The following will describe a stacked connector according to an embodiment and a wire harness that includes the stacked connector. FIG. 1 is an exploded perspective view showing a wire harness 10 according to an embodiment. FIG. 2 is a front view showing the wire harness 10 according to the embodiment. Note that terminal-equipped electric wires 15 are not shown in FIGS. 1 and 2. Also, the terminal-equipped electric wires 15 may not be shown in FIG. 3 onward.

The wire harness 10 includes a plurality of stacked connectors 12, and a joint connector 40 to which the plurality of stacked connectors 12 are to be connected. Here, in the wire harness 10, circuits of the plurality of stacked connectors 12 are shorted by being connected to the joint connector 40.

Stacked Connector

Figure 3:
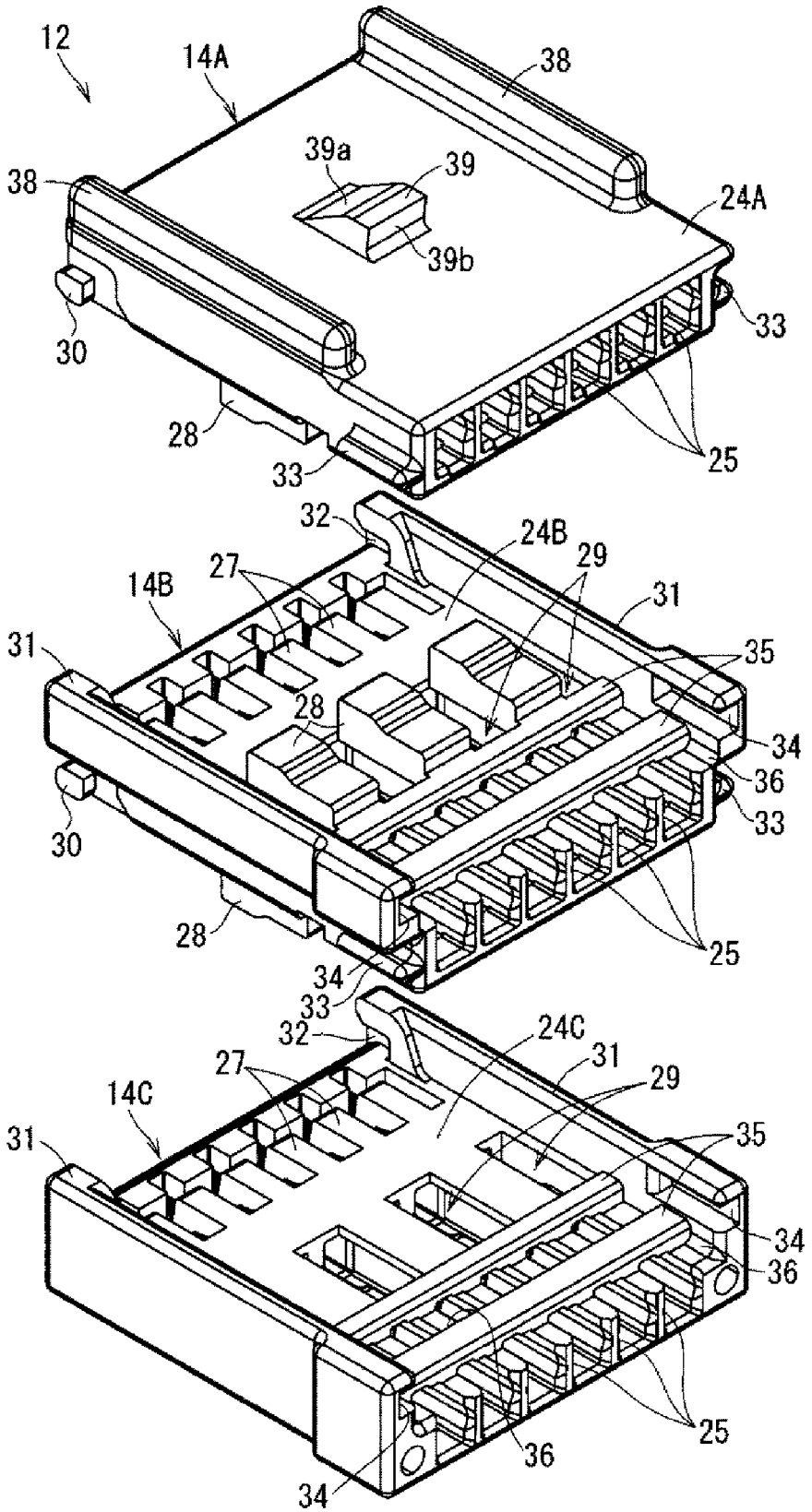
FIG. 3 is an exploded perspective view showing a stacked connector.
Figure 4:
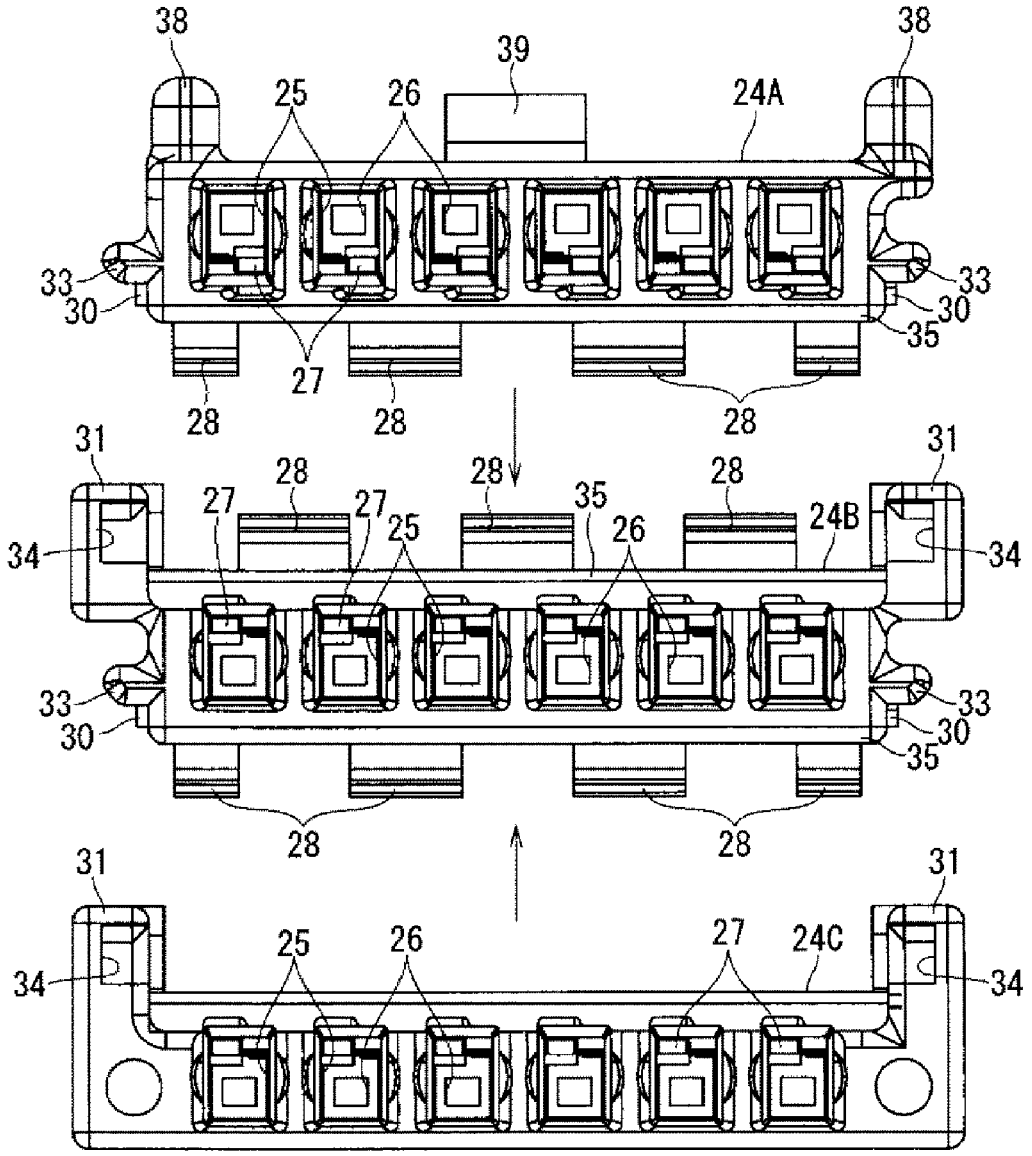
FIG. 4 is an exploded front view showing the stacked connector.
Figure 5:
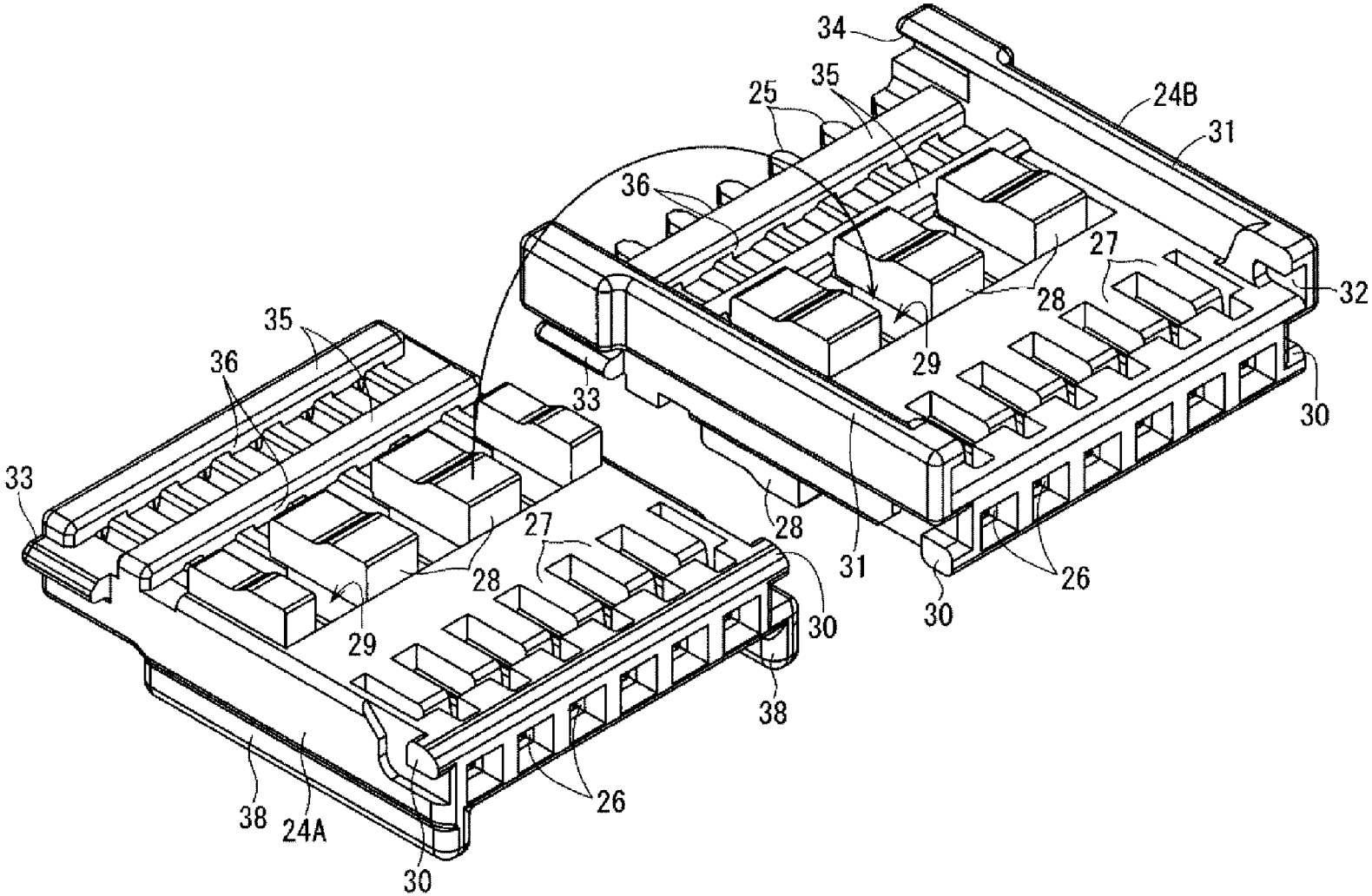
FIG. 5 is a diagram illustrating surfaces of the stacked connector that face each other in a joined state.
Figure 6:
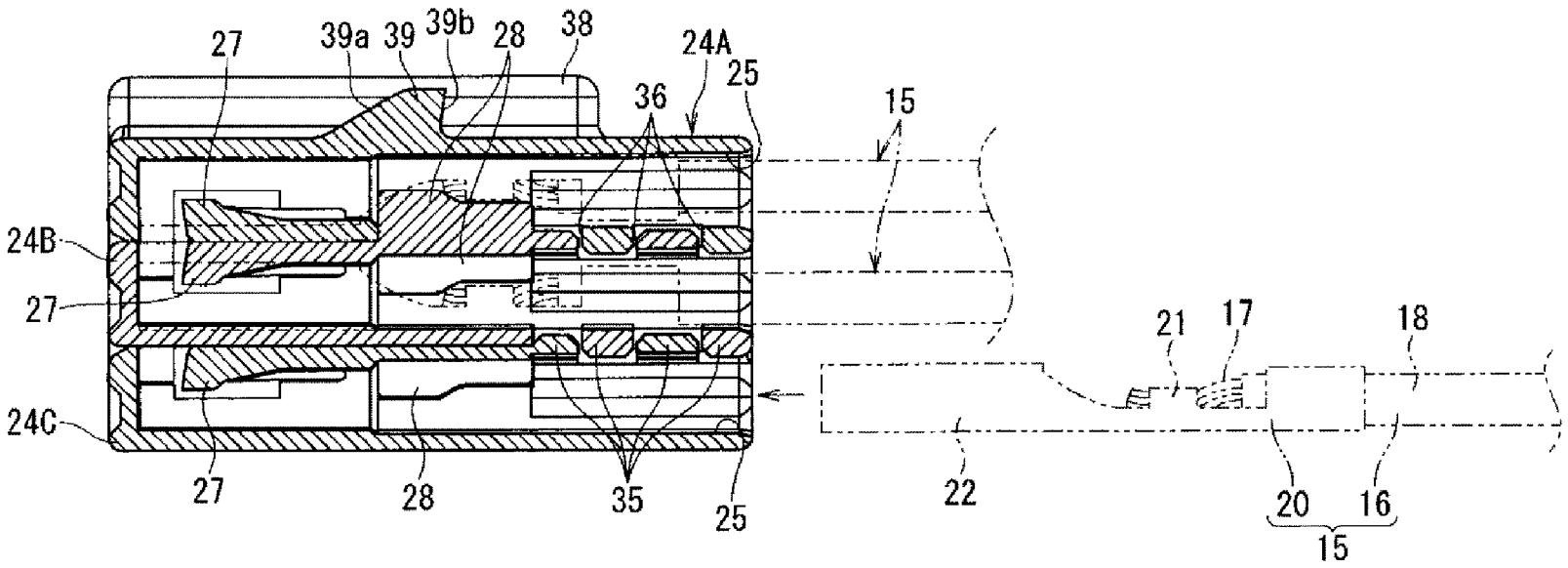
FIG. 6 is a longitudinal cross-sectional view showing the stacked connector.
Figure 7:
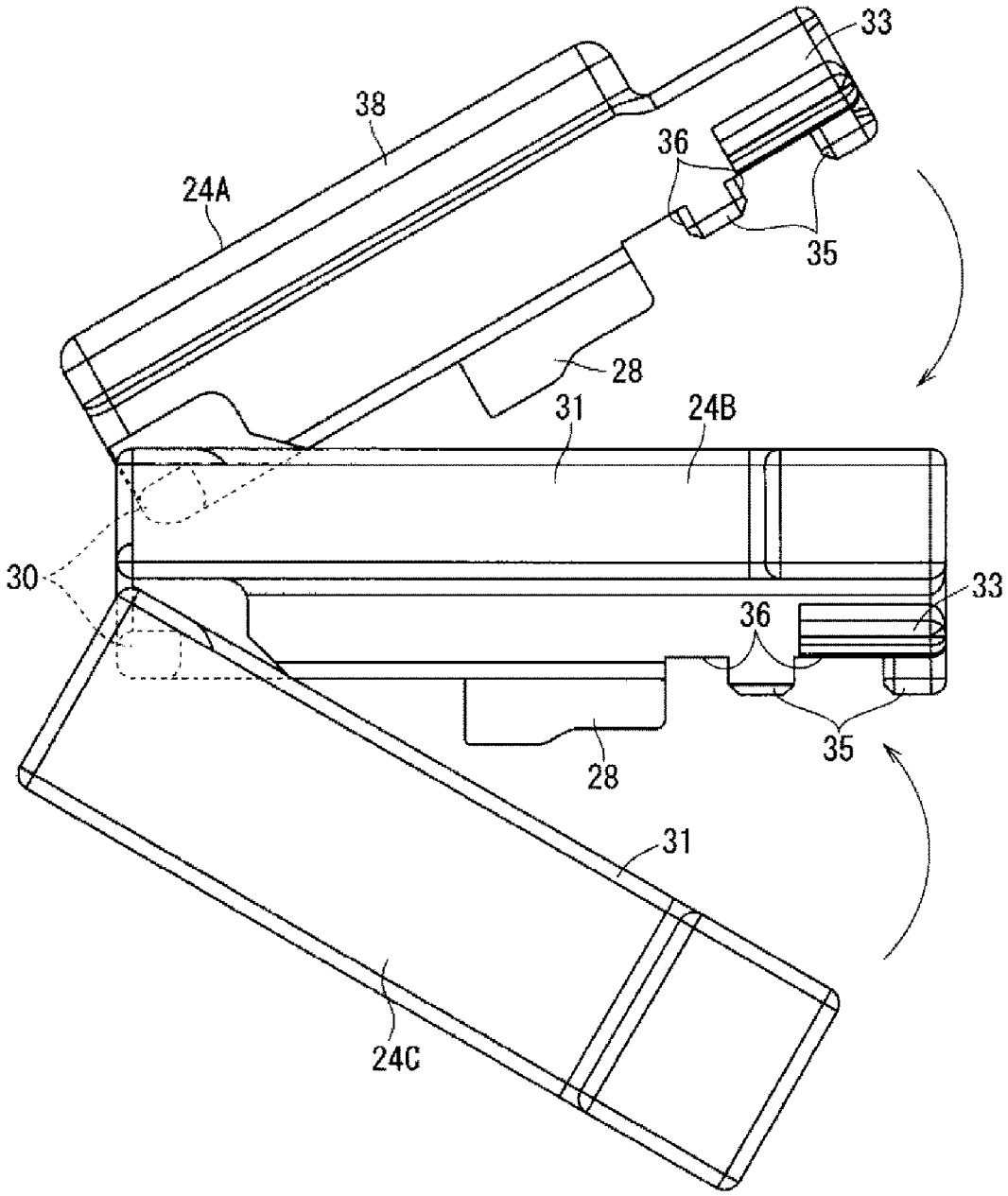
FIG. 7 is a diagram illustrating how the stacked connector is formed by combining split connectors.

FIG. 3 is an exploded perspective view showing a stacked connector 12. FIG. 4 is an exploded front view showing the stacked connector 12. FIG. 5 is a diagram illustrating surfaces of the stacked connector 12 that face each other in a joined state. FIG. 6 is a longitudinal cross-sectional view showing the stacked connector 12. FIG. 7 is a diagram illustrating how the stacked connector 12 is formed by combining split connectors.

The stacked connector 12 is formed by joining a plurality of split connectors 14 to each other. Here, the split connectors 14 are stacked in three layers to form the stacked connector 12. The split connectors 14 may be stacked in two layers, or may be stacked in four or more layers.

The split connectors 14 each include a split connector housing 24 provided with a plurality of terminal receiving chambers 25, and a plurality of terminal-equipped electric wires 15 that include terminals 20 received in the terminal receiving chambers 25 and electric wires 16 to which the terminals 20 are connected. At least one of the split connector housings 24 is provided with a locking portion (a second terminal locking portion 28 here) formed in a protruding shape that protrudes outward and is capable of locking the terminal-equipped electric wire 15 received in the split connector housing 24 of a joining counterpart.

Here, the terminal-equipped electric wire 15 will be described first. Here, as shown in FIG. 6, the terminal-equipped electric wire 15 is formed with the terminal 20 being connected to a leading end of an electric wire 16.

The electric wire 16 includes a core wire 17 and an insulating coating 18 covering the core wire 17. The core wire 17 is made of a material such as aluminum, an aluminum alloy, copper, or a copper alloy. The core wire 17 may be constituted by one wire, or may also be constituted by a plurality of wires. If the core wire 17 is constituted by a plurality of wires, the wires may or may not be twisted. The insulating coating 18 is formed by extruding a resin such as polyethylene or polyvinyl chloride around the core wire 17, for example. The electric wires 16 are each provided with a core wire exposure portion where the core wire 17 is exposed, at an end portion thereof. The terminals 20 are connected to the core wire exposure portions.

The terminal 20 is made of any metal material such as copper or a copper alloy. The terminal 20 may be plated with any metal such as tin or nickel. The terminal 20 is formed by pressing a metal plate material into a predetermined shape and bending the resulting material, for example. The terminal 20 includes an electric wire connection portion 21 and a counterpart connection portion 22.

The electric wire connection portion 21 is formed in a shape including a crimping portion in which a crimping piece is crimped to the electric wire 16. The example shown in FIG. 6 includes a core wire crimping piece that is crimped to the core wire 17 as the crimping piece, and a coating crimping piece that is crimped to the insulating coating 18, but the electric wire connection portion 21 may also be constituted by only a core wire crimping piece. Naturally, the shape of the electric wire connection portion 21 is not limited thereto. For example, the terminal 20 may also be joined to the core wire 17 through welding or the like. Also, for example, the terminal 20 may be formed in a so-called pressure-contact terminal shape in which the terminal 20 pierces through the insulating coating 18 and is connected to the core wire 17.

The counterpart connection portion 22 is connected to a counterpart connection member. Here, the terminal 20 is connected to a tab terminal 64 of a joint terminal 60, which will be described later, in the joint connector 40. Specifically, the counterpart connection portion 22 is formed in a box shape and a so-called female terminal shape according to which the counterpart connection portion 22 is connected to the counterpart tab terminal 64 inserted into this box. Thus, the tab terminal 64 of the joint terminal 60 that is to be connected to the terminal 20 is formed in a male terminal shape.

Here, the counterpart connection portion 22 formed in a box shape is provided with a lance engaging portion (not shown) that engages with a lance formed in the split connector housing 24.

Next, the split connector housing 24 will be described.

Both surfaces of at least one of the split connector housings 24 located at an intermediate position in the stacking direction are provided with second terminal locking portions 28. Also, pairs of split connectors 14 that are adjacent to each other include at least a pair of split connectors 14 that are provided with second terminal locking portions 28 capable of respectively locking terminal-equipped electric wires 15 received in the counterpart split connector housing 24, and through holes 29 for receiving the counterpart locking portions, in a manner in which the second terminal locking portions 28 and the through holes 29 are located in an alternating manner in a direction intersecting the stacking direction.

Also, the split connector housings 24 located in one surface layer of each of the plurality of stacked connectors 12 are provided with erroneous fitting restricting ribs 38 having different shapes. Also, the split connector housings 24 located in layers other than the one surface layer of each of the plurality of stacked connectors 12 are formed in the same shape.

More specifically, as described above, here, three split connectors 14 are stacked to form one stacked connector 12. The three split connectors 14 will be distinguished from each other as needed below, and the split connectors 14 will be referred to as an upper connector 14A, a middle connector 14B, and a lower connector 14C in this order from the one surface layer side.

The split connector housings 24 are formed through injection molding using a synthetic resin as a material, for example. The split connector housings 24 are provided with terminal receiving chambers 25 for receiving the terminals 20 of the terminal-equipped electric wires 15. The terminal receiving chambers 25 are formed in a manner to be recessed in a hole shape from one side surface of the split connector housing 24 toward another side surface. Although an example in which six terminal receiving chambers 25 are formed in one split connector housing 24 will be described here, the number of terminal receiving chambers 25 formed in one split connector housing 24 is not limited thereto. The number of terminal receiving chambers 25 formed in one split connector housing 24 may be five or less. Alternatively, the number of terminal receiving chambers 25 may also be seven or more. Also, a wall portion defining a terminal receiving chamber 25 is provided with a recessed surface corresponding to the external shape of the electric wire 16. This narrows the pitch of terminal receiving chambers 25, and thus it is possible to form portions of the terminal receiving chambers 25 other than the recessed surfaces in a shape that is slightly smaller (e.g., smaller by about 0.1 to 0.3 mm) than a conventional shape thereof without reducing the thickness of wall portions for partitioning the terminal receiving chambers 25 as much as possible (without making the wall portions other than the recessed surface smaller). Accordingly, the width of the split connector housing 24 can be reduced while an electric wire 16 having the same diameter as a conventional electric wire can be received by the terminal receiving chamber 25.

Also, a wall surface of each split connector housing 24 located forward of the terminal receiving chambers 25 (another side surface of the split connector housing 24) is provided with insertion holes 26. The insertion holes 26 are formed to allow passage of the tab terminals 64 of the joint terminal 60 in the joint connector 40. As a result of the tab terminals 64 inserted into the insertion holes 26 coming into contact with the terminals 20 received in the terminal receiving chambers 25, the joint terminal 60 and the terminal-equipped electric wires 15 are electrically connected to each other.

Also, the split connector housings 24 are provided with first terminal locking portions 27 for locking the terminals 20 housed in the terminal receiving chambers 25. The first terminal locking portions 27 are portions referred to as a so-called lance. Here, the first terminal locking portions 27 are formed integrated with the split connector housing 24. Thus, the first terminal locking portions 27 are made of resin. Specifically, the first terminal locking portion 27 is formed to be capable of locking to a peripheral edge of a locking hole (not shown) serving as a lance engaging portion formed in a box-shaped counterpart connection portion 22 provided at the leading end of the terminal 20. The first terminal locking portion 27 is formed in a cantilever shape, for example, and is elastically deformable to pivot about the base end portion thereof. In the example shown in FIG. 6, the first terminal locking portion 27 extends toward the back side of the terminal receiving chamber 25 with a portion on the opening side of the terminal receiving chamber 25 being supported. The first terminal locking portion 27 is pressed by the terminal 20 inserted through the opening of the terminal receiving chamber 25 and elastically deforms to retract from the terminal receiving chamber 25, and when the terminal 20 is inserted to a predetermined position of the terminal receiving chamber 25, the first terminal locking portion 27 elastically returns and locks the terminal 20.

Also, at least one of the split connector housings 24 is provided with the second terminal locking portions 28 for locking the terminals 20 housed in the terminal receiving chambers 25 of the joining counterpart. The second terminal locking portions 28 are portions that are referred to as a so-called retainer. Here, the second terminal locking portions 28 are formed integrated with the split connector housing 24. Thus, the second terminal locking portions 28 are made of resin. Specifically, the second terminal locking portions 28 are formed in a protruding shape protruding toward the counterpart split connector housing 24. At this time, the counterpart split connector housing 24 is provided with through holes 29 for receiving the second terminal locking portions 28. The through holes 29 are formed in all of the split connector housings 24.

More specifically, here, the second terminal locking portion 28 is formed so as to fit into a half region of one terminal receiving chamber 25 in the width direction. Also, the second terminal locking portion 28 can protrude into the terminal receiving chamber 25 through the through hole 29. The second terminal locking portion 28 locks a rear end side of the terminal 20 that is located rearward of a portion of the terminal 20 that locks to the first terminal locking portion 27. Here, the second terminal locking portion 28 is formed to catch on and lock a rear edge portion of the counterpart connection portion 22 formed in a box shape.

Here, the second terminal locking portions 28 are formed on a lower surface of the upper connector housing 24A, and upper and lower surfaces of the middle connector housing 24B. Also, the through holes 29 are formed in the lower surface of the upper connector housing 24A, the upper surface of the middle connector housing 24B, and the upper surface of the lower connector housing 24C. Also, as shown in FIG. 5, the second terminal locking portions 28 formed on the lower surface of the upper connector housing 24A protrude into the terminal receiving chambers 25 of the middle connector housing 24B through the through holes 29 formed in the upper surface of the middle connector housing 24B, and lock the terminals 20 housed in the terminal receiving chambers 25 of the middle connector housing 24B. Similarly, the second terminal locking portions 28 formed on the upper surface of the middle connector housing 24B protrude into the terminal receiving chambers 25 of the upper connector housing 24A through the through holes 29 formed in the lower surface of the upper connector housing 24A, and lock the terminals 20 housed in the terminal receiving chambers 25 of the upper connector housing 24A. Also, the second terminal locking portions 28 formed on the lower surface of the middle connector housing 24B protrude into the terminal receiving chambers 25 of the lower connector housing 24C through the through holes 29 formed in the upper surface of the lower connector housing 24C, and lock the terminals 20 housed in the terminal receiving chambers 25 of the lower connector housing 24C.

At this time, as for one housing, the lower surface of the upper connector housing 24A is provided with the second terminal locking portions 28 and the through holes 29 in an alternating manner in the width direction. Similarly, the upper surface of the middle connector housing 24B is also provided with the second terminal locking portions 28 and the through holes 29 in an alternating manner in the width direction. Also, at this time, as for the second terminal locking portions 28, the second terminal locking portions 28 formed on the upper connector housing 24A and the second terminal locking portions 28 formed on the upper surface of the middle connector housing 24B are formed in an alternating manner in the width direction. At this time, out of the second terminal locking portions 28 formed on the upper connector housing 24A and the second terminal locking portions 28 formed on the upper surface of the middle connector housing 24B, a second terminal locking portion 28 located at an end portion in the width direction is formed to have a size capable of locking one terminal 20, and a second terminal locking portion 28 located at an intermediate position in the width direction is formed to have a size capable of locking two terminals 20. Also, as for the through holes 29, the through holes formed in the upper connector housing 24A and the through holes formed in the middle connector housing 24B are formed in an alternating manner in the width direction. At this time, out of the through holes 29 formed in the upper connector housing 24A and the through holes formed in the upper surface of the middle connector housing 24B, a through hole 29 located at an end portion in the width direction is formed to have a size corresponding to one terminal receiving chamber 25, and a through hole 29 located at an intermediate position in the width direction is formed to have a size spanning two terminal receiving chambers 25.

At this time, the terminals 20 inserted into the upper connector housing 24A and the terminals 20 inserted into the middle connector housing 24B face away from each other about the axis extending in the longitudinal direction of the electric wires 16, as per the relationship between positions where the second terminal locking portions 28 are provided. More specifically, the core wires 17 of the terminals 20 inserted into the upper connector housing 24A are exposed downward. Accordingly, the second terminal locking portions 28 of the middle connector housing 24B located below the terminals 20 inserted into the upper connector housing 24A can lock the terminals 20 inserted into the upper connector housing 24A. Also, the core wires 17 of the terminals 20 inserted into the middle connector housing 24B are exposed upward.

Accordingly, the second terminal locking portions 28 of the upper connector housing 24A located above the terminals 20 inserted into the middle connector housing 24B can lock the terminals 20 inserted into the middle connector housing 24B. Note that the terminals 20 inserted into the lower connector housing 24C and the terminals 20 inserted into the middle connector housing 24B face each other.

Also, the split connector housing 24 is provided with a function of joining two counterpart split connector housings 24 and maintaining a joined state. Here, one of two counterpart split connector housings 24 is provided with leading end side protrusions 30, and the other of the two counterpart split connector housings 24 is provided with leading end side grooves 32 in which the leading end side protrusions 30 are to be housed. Similarly, one of two counterpart split connector housings 24 is provided with rear end side protrusions 33, and the other of the two counterpart split connector housings 24 is provided with rear end side grooves 34 in which the rear end side protrusions 33 are to be housed.

Specifically, here, the leading end side protrusions 30 are formed on the leading end side (the insertion hole 26 side) of side surfaces that are located on both sides of the upper connector housing 24A and the middle connector housing 24B in the width direction and are oriented outward in the width direction, in a manner in which the leading end side protrusions 30 have a protruding shape oriented outward in the width direction. Also, the middle connector housing 24B and the lower connector housing 24C are provided with protruding side wall portions 31 that protrude upward from the upper surfaces thereof at both end portions in the width direction. A leading end side groove 32 is formed in a shape recessed in the width direction on the leading end side (the insertion hole 26 side) of a width-direction inward surface of this protruding side wall portion 31. The front portion of the leading end side groove 32 is open in a direction in which the terminal 20 is inserted. The leading end side protrusion 30 can be inserted into the leading end side groove 32 through this opening. As shown in FIG. 7, counterpart split connector housings 24 can pivot in a state in which the leading end side protrusions 30 are housed in the leading end side grooves 32 and the rear end side protrusions 33 are not housed in the rear end side grooves 34. This is achieved due to the leading end side protrusions 30 being formed shorter than the rear end side protrusions 33 and surfaces of the leading end side protrusions 30 that face the leading ends in the terminal inserting direction and extend from a side surface to a lower surface thereof being curved.

Here, the leading end side protrusions 30 and the leading end side grooves 32 are portions housed in a housing receiving portion 43 of the joint connector 40. At this time, in order to avoid an increase in the size, in the width direction, of portions of the stacked connector 12 in which the leading end side protrusions 30 and the leading end side grooves 32 are formed, peripheral portions of the leading end side protrusions 30 of side surfaces oriented outward in the width direction in the split connector housings 24 are recessed, thus forming the leading end side protrusions 30. Also, a portion of the wall of the width-direction inward surface of the protruding side wall portion 31 that defines the leading end side groove 32 protrudes from the peripheral portion, thus forming the leading end side groove 32.

Also, here, the rear end side protrusions 33 are formed on the rear end side (the opening side of the terminal receiving chamber 25) of side surfaces that are located on both sides of the upper connector housing 24A and the middle connector housing 24B in the width direction and are oriented outward in the width direction, in a manner in which the rear end side protrusions 33 have a protruding shape that is oriented outward in the width direction. Also, the rear end side grooves 34 formed in a shape recessed in the width direction are formed on the rear end side (the opening side of the terminal receiving chamber 25) of the width-direction inward surfaces in the protruding side wall portions 31 of the middle connector housing 24B and the lower connector housing 24C. As described above, as shown in FIG. 7, counterpart split connector housings 24 can pivot in a state in which the leading end side protrusions 30 are housed in the leading end side grooves 32 and the rear end side protrusions 33 are not housed in the rear end side grooves 34. Also, in the split connector housing 24 that has been pivoted, the rear end side protrusions 33 can be fitted to the rear end side grooves 34. Here, this is achieved through elastic deformation of peripheral edge portions of the rear end side protrusions 33 and the rear end side grooves 34. At this time, the surface of the rear end side protrusion 33 that extends from a width-direction outward side surface to the lower surface thereof is a curved surface. Accordingly, the rear end side protrusions 33 can be easily fitted to the rear end side grooves 34.

Here, the leading end side protrusions 33 and the leading end side grooves 34 are portions that are not housed in the housing receiving portion 43 of the joint connector 40. Thus, the need to avoid an increase in the size of the rear end side protrusions 33 and the rear end side grooves 34 in the stacked connector 12 in the width direction is less than that of the leading end side protrusions 30 and the leading end side grooves 32. Thus, the rear end side protrusions 33 protrude more outward in the width direction than the leading end side protrusions 30. Also, a portion of the width-direction inward surface of the protruding side wall portion 31 is recessed from the peripheral portion thereof, thus forming the rear end side groove 34.

Also, here, surfaces of the split connector housings 24 that are to face each other on the rear end side (the opening side of the terminal receiving chamber 25) are provided with width-direction protruding portions 35 that protrude toward counterparts and extend in the width direction, and width-direction recessed portions 36 in which the counterpart width-direction protruding portions 35 are housed in the joined state. The width-direction protruding portions 35 and the width-direction recessed portions 36 are formed substantially spanning the width thereof in the width direction. As a result of the width-direction protruding portions 35 of the two counterpart split connector housings 24 being housed in the width-direction recessed portions 36 in the joined state, positions of the joined two split connector housings 24 are unlikely to shift in the direction in which the terminals 20 are inserted. Specifically, as shown in FIG. 5, the lower surface of the upper connector housing 24A is provided with the two width-direction protruding portions 35 at an interval, and a portion between the two width-direction protruding portions 35 is provided with the width-direction recessed portions 36. Also, the upper surface of the middle connector housing 24B is provided with two width-direction recessed portions 36 at an interval, and a portion between the two width-direction recessed portions 36 is provided with a width-direction protruding portion 35. The lower surface of the middle connector housing 24B and the upper surface of the lower connector housing 24C are also provided with protruding portions and recessed portions that are similar to the width-direction protruding portions 35 and the width-direction recessed portions 36 that are provided on the lower surface of the upper connector housing 24A and the upper surface of the middle connector housing 24B. Note that here, in order to avoid an increase in the size in the stacking direction in the stacked connector 12, as shown in FIG. 5, in a state in which the split connector housing 24 is a single unit, the terminal receiving chambers 25 are exposed at portions to be provided with the width-direction recessed portion 36. The exposed portions are covered by the width-direction protruding portions 35 of the joining counterpart.

The plurality of stacked connectors 12 are each provided with the erroneous fitting restricting ribs 38. In order to avoid a mistake in which the positions at which the plurality of stacked connectors 12 are fitted to the joint connector 40 shift, the erroneous fitting restricting ribs 38 are formed at positions that are different from each other. Here, the erroneous fitting restricting ribs 38 are formed on the upper connector housing 24A. Also, here, the erroneous fitting restricting ribs 38 are laterally arranged, and are provided at different positions of two upper connector housings 24A1 and 24A2 that are connected to the joint connector 40 from one side.

More specifically, the upper surfaces of the upper connector housings 24A1 and 24A2 are provided with two erroneous fitting restricting ribs 38 that are spaced apart from each other in the width direction. As shown in FIG. 2, in the upper connector housing 24A1 of the stacked connector 12 to be connected to the joint connector 40 on the left side when viewed from the front, the left erroneous fitting restricting rib 38 is formed at the same position as the left rear end side protrusion 33 in the width direction, and the right erroneous fitting restricting rib 38 is formed inward in the width direction of the right rear end side protrusion 33 in the width direction. On the other hand, in the upper connector housing 24A2 of the stacked connector 12 to be connected to the joint connector 40 on the right side when viewed from the front, the left erroneous fitting restricting rib 38 is formed inward in the width direction of the left rear end side protrusion 33 in the width direction, and the right erroneous fitting restricting rib 38 is formed at the same position as the right rear end side protrusion 33 in the width direction. Note that the middle connector housing 24B and the lower connector housing 24C in the stacked connector 12 to be connected to the joint connector 40 on the left side when viewed from the front have the same shape as the middle connector housing 24B and the lower connector housing 24C in the stacked connector 12 to be connected to the joint connector 40 on the right side when viewed from the front.

Also, the upper surface of the upper connector housing 24A is provided with the erroneous fitting restricting ribs 38, whereas the lower surface of the lower connector housing 24A is not provided with the erroneous fitting restricting ribs 38. Accordingly, the upper and lower sides of the stacked connector 12 can be determined. As a result, the stacked connector 12 is kept from being connected upside down to the joint connector 40.

Note that the upper connector housings 24A1 and 24A2 of the two stacked connectors 12 connected from the opposite side to the front view shown in FIG. 2 have the same shape as the upper connector housings 24A1 and 24A2 of the two stacked connectors 12 shown in FIG. 2. Naturally, all of the erroneous fitting restricting ribs 38 formed on the plurality of stacked connectors 12 connected to one joint connector 40 may be formed in different forms. This will be described later in detail.

Also, the stacked connector 12 is provided with a locking protrusion 39 for locking to the joint connector housing 42 after insertion. The locking protrusion 39 can be inserted into and locked to a locking receiving portion 45 formed in the joint connector housing 42. Here, one locking protrusion 39 is formed at a position close to the center of the upper surface of the upper connector housing 24A. The locking protrusion 39 can be easily inserted into the locking receiving portion 45 due to the front surface thereof in the insertion direction being an inclined surface 39*a*. Also, the rear surface of the locking protrusion 39 in the insertion direction is a catching surface 39*b* that catches on the locking receiving portion 45 in a state in which the locking protrusion 39 is inserted into the locking receiving portion 45. Here, a cantilever-shaped operation portion that can be operated by an operator to release locking and can easily deform elastically is omitted from the locking protrusion 39. This reduces the size of a portion in the wire harness 10 where the joint connector 40 and the stacked connector 12 are fitted to each other.

Joint Connector

Figure 8:
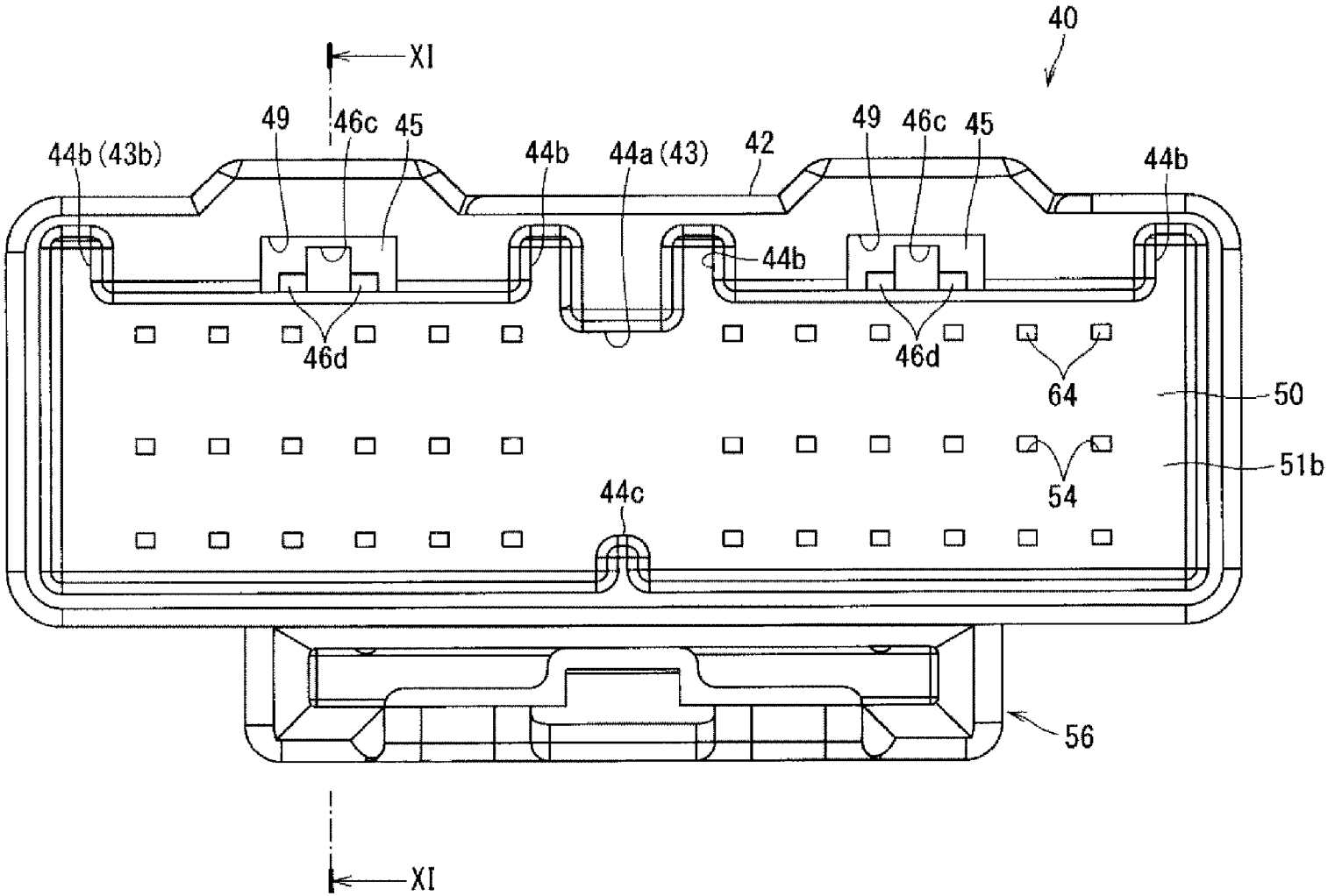
FIG. 8 is a front view showing a joint connector.
Figure 9:
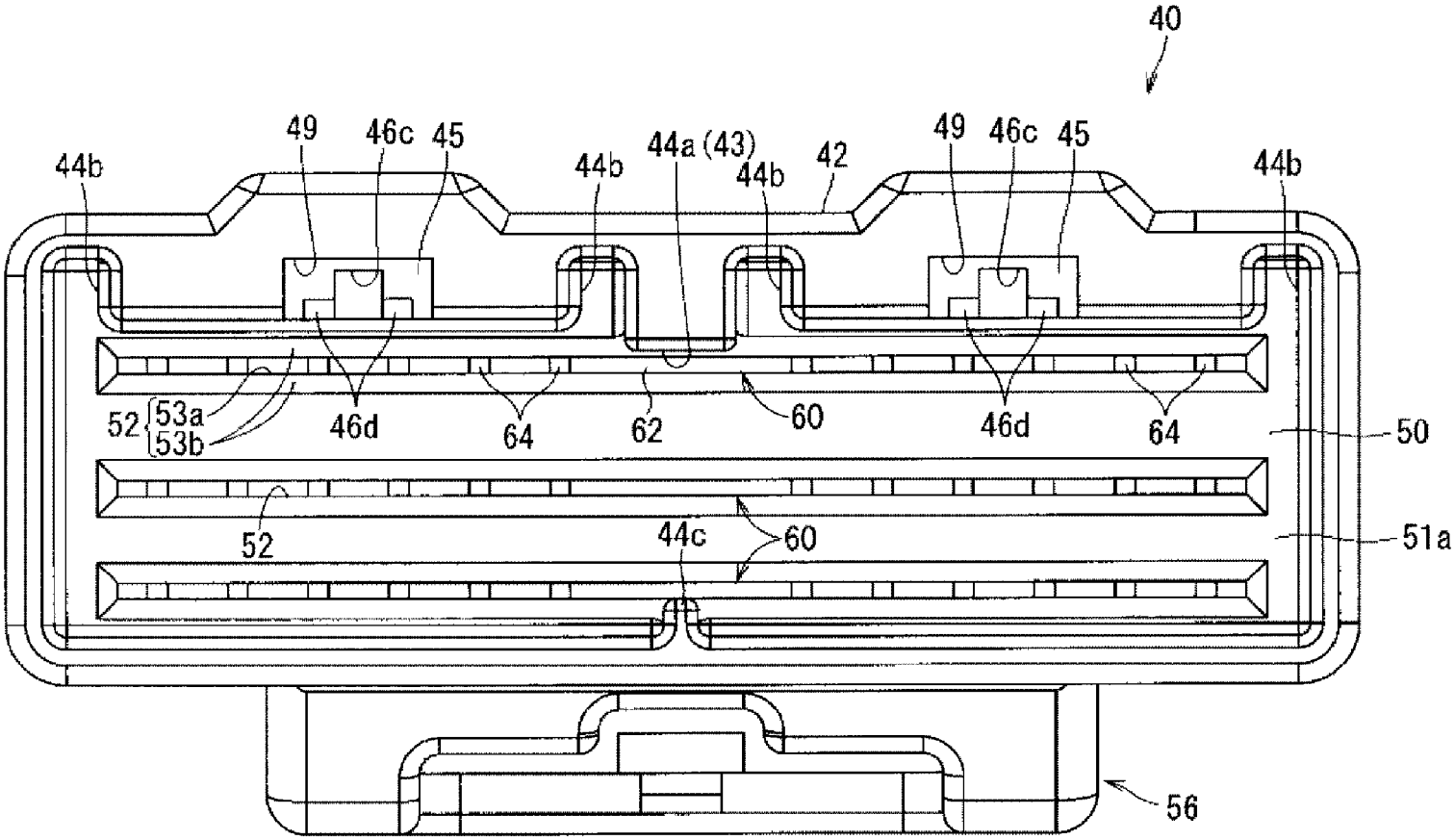
FIG. 9 is a rear view showing the joint connector.
Figure 10:
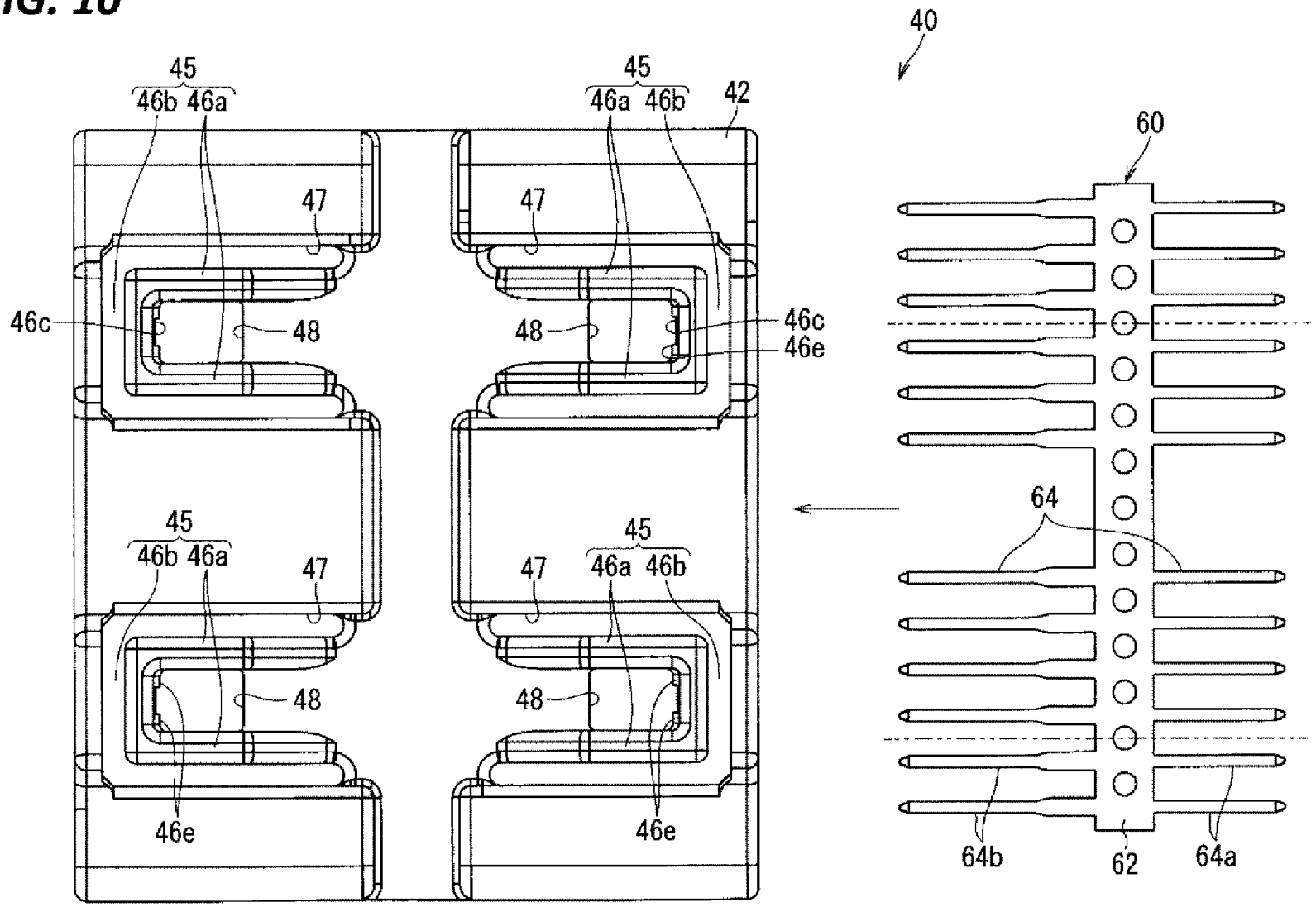
FIG. 10 is an exploded plan view showing the joint connector.
Figure 11:
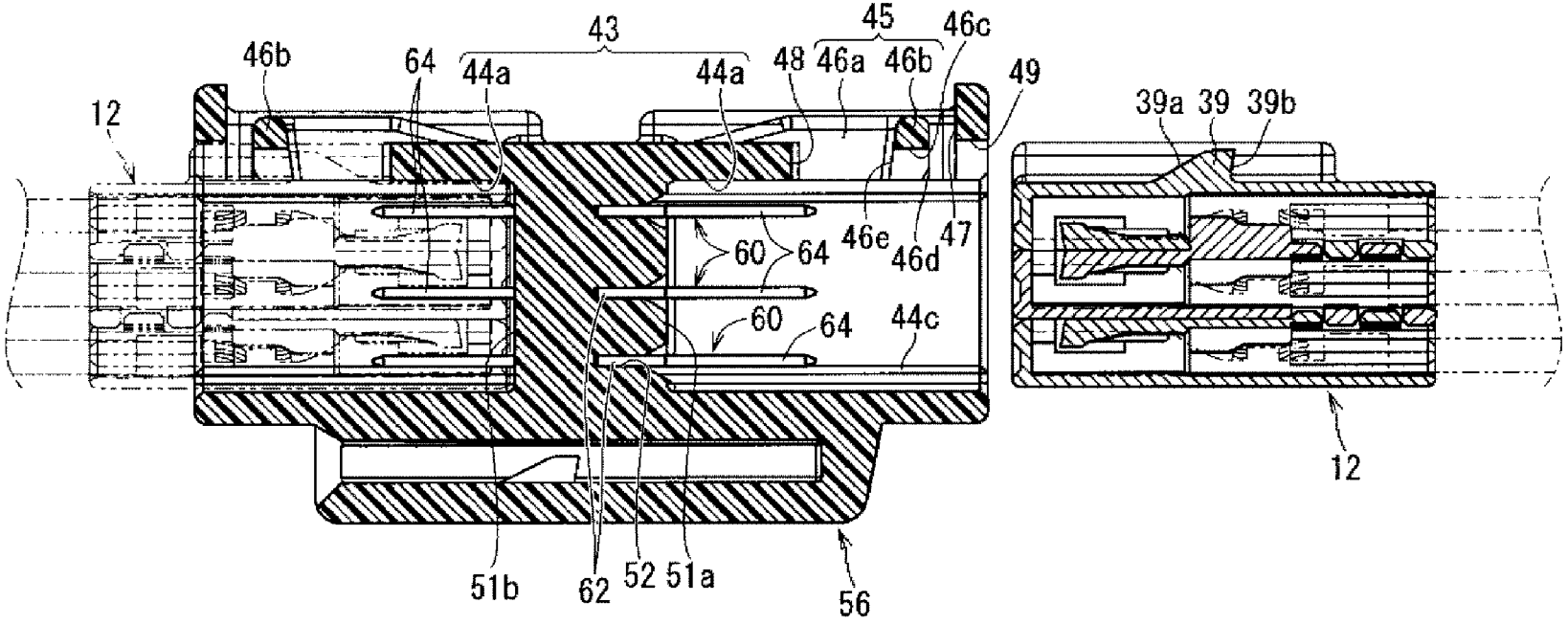
FIG. 11 is a cross-sectional view cut along line XI-XI shown in FIG. 8.

Next, the joint connector 40 will be described. FIG. 8 is a front view showing the joint connector 40. FIG. 9 is a rear view showing the joint connector 40. FIG. 10 is an exploded plan view showing the joint connector 40. FIG. 11 is a cross-sectional view cut along line XI-XI in FIG. 8.

The joint connector 40 is formed to be capable of being fitted to the stacked connectors 12. The plurality of stacked connectors 12 are connected to one joint connector 40. Specifically, here, a plurality of stacked connectors 12 are connected side-by-side to one joint connector 40 from one side. Specifically, here, two stacked connectors 12 are connected to one joint connector 40 from one side, and two stacked connectors 12 are also connected thereto from the other side. At this time, the stacked connectors 12 are formed to be capable of being independently fitted to the joint connector 40. Specifically, the joint connector 40 includes a joint connector housing 42 and joint terminal 60.

The joint connector housing 42 receives and supports the joint terminals 60. Also, the joint housing is provided with a receiving space 44*a* for receiving the stacked connectors 12. Here, the joint connector housing 42 can receive the connector housings of a plurality (two, here) of stacked connectors 12 to be connected thereto from one side in one receiving space 44*a*. Also, the joint connector housing 42 can receive the connector housings of a plurality (two, here) of stacked connectors 12 to be connected thereto from the other side in one receiving space 44*a*. Specifically, the joint connector housing 42 includes the housing receiving portions 43, the locking receiving portions 45, and joint terminal support portions 52.

The housing receiving portion 43 is a portion for receiving the connector housing of the stacked connector 12. Here, the joint connector housing 42 is provided with two receiving spaces 44*a* that are open in opposite directions, thus forming the housing receiving portion 43. Each receiving space 44*a* can receive the connector housings of two stacked connectors 12 disposed side-by-side. Also, the receiving spaces 44*a* are partitioned by a wall portion 50, and the wall portion 50 is provided with the joint terminal support portions 52.

At this time, the receiving space 44*a* is not provided with a partition wall portion for partitioning two stacked connectors 12 housed side-by-side in the receiving space 44*a*. This suppresses an increase in the size of the joint connector housing 42 in the width direction in a case where two stacked connectors 12 are to be housed side-by-side in one receiving space 44*a*. The two stacked connectors 12 housed side-by-side in one receiving space 44*a* are formed longer in the width direction than in the height direction. Also, the two stacked connectors 12 are housed in one receiving space 44*a* in a manner in which the two stacked connectors 12 are arranged side-by-side in the lengthwise direction.

Also, here, as described above, the two stacked connectors 12 connected to one receiving space 44*a* are each provided with erroneous fitting restricting ribs 38 having different shapes. Thus, the receiving spaces 44*a* are formed to be capable of housing the erroneous fitting restricting ribs 38 corresponding to the corresponding positions. Thus, here, portions of the housing receiving portion 43 serve as rib receiving portions 43*b* for housing the erroneous fitting restricting ribs 38. More specifically, the two housing receiving portions 43 are each provided with four groove-shaped portions 44*b* serving as the rib receiving portions 43*b*. Also, two of the four groove-shaped portions 44*b* located on the left side receive the erroneous fitting restricting ribs 38 of the stacked connector 12 housed on the left side. Also, two of the four groove-shaped portions 44*b* located on the right side receive the erroneous fitting restricting ribs 38 of the stacked connector 12 housed on the right side. Because the positions of these two sets of the groove-shaped portions 44*b* are different from each other with respect to the center of the stacked connector 12 in the width direction, two stacked connectors 12 can be housed at the corresponding positions in the receiving space 44*a*.

Note that one of the inward surfaces of the inner circumferential wall portion defining the receiving space 44*a* (here, a surface of the stacked connector 12 that faces the lower connector 14C) is provided with a positioning rib 44*c* for positioning the two stacked connectors 12. Here, in the connector housing of the stacked connector 12, the width of a rear end portion protruding outward from the receiving space 44*a* of the joint connector 40 is set to be larger than the width of a leading end portion housed inside the receiving space 44*a* of the joint connector 40. Also, the two stacked connectors 12 that are connected side-by-side to one receiving space 44*a* are in a state in which the rear end portions thereof are in contact with each other or are located closer to each other than the leading end portions thereof are. The positioning rib 44*c* is housed in a gap between the leading end portions that is formed at this time. Also, the positioning rib 44*c* has a small height, which is the length of the positioning rib 44*c* that protrudes from the flat surface of the inner surface of the receiving space 44*a*. Specifically, here, the height of the positioning rib 44*c* is set to be smaller than or equal to the width (less than the width here) in the width direction of the joint connector housing 42. Thus, the positioning rib 44*c* is unlikely to be damaged or the like.

The locking receiving portion 45 is a portion for receiving the locking protrusion 39. Here, the locking receiving portion 45 can deform elastically more easily than the locking protrusion 39. Specifically, the locking receiving portion 45 includes a locking receiving piece 46 and two through holes 47 and 48 formed in the periphery of the locking receiving piece 46.

The locking receiving piece 46 is formed on the joint connector housing 42. Here, as a result of forming the two through holes 47 and 48 in the upper surface of the joint connector housing 42, a portion between the two through holes 47 and 48 forms the locking receiving piece 46. The locking receiving piece 46 is formed in a cantilever shape extending toward the opening of the housing receiving portion 43 due to the first through hole 47 being formed. Also, the locking protrusion 39 is housed in the second through hole 48. Also, the locking receiving piece 46 is configured such that a force for inserting the locking protrusion 39 thereto is reduced due to the second through hole 48 being formed.

More specifically, the first through hole 47 is formed in a U-shape in a plan view, in an outer peripheral area of the locking receiving piece 46 and a portion connected thereto. Also, the second through hole 48 is formed in a rectangular shape in a plan view, on the inner side of the locking receiving piece 46 and the portion connected thereto. Accordingly, the locking receiving piece 46 includes a pair of protruding pieces 46*a* extending from the main body of the joint connector housing 42, and a connecting piece 46*b* for connecting the leading ends of the pair of protruding pieces 46*a*. The lower surface of the connecting piece 46*b* is provided with a recessed portion 46*c*. A gap is formed between the connecting piece 46*b* and the locking protrusion 39 through formation of the recessed portion 46*c*. For example, it is conceivable to insert, into this gap, a jig for releasing locking through elastic deformation of the locking receiving piece 46. Also, portions of the connecting piece 46*b* that are located lateral to the recessed portion 46*c* are portions that catch on the inserted locking protrusion 39. In the portions of the connecting piece 46*b* that are located lateral to the recessed portion 46*c*, a surface oriented on the opening side is an inclined surface 46*d* corresponding to the inclined surface 39*a* of the locking protrusion 39. Accordingly, the locking receiving piece 46 can easily shift to an elastic deformation state at the time of insertion of the locking protrusion 39. Also, in the portions of the connecting piece 46*b* that are located lateral to the recessed portion 46*c*, the surface that is located opposite to the inclined surface 46*d* is a receiving surface 46*e* that catches on the catching surface 39*b* of the locking protrusion 39.

Note that, in the joint connector housing 42, an opening edge portion of the receiving space 44*a*, that is, the opening edge portion of the surface provided with the locking receiving portion 45 is provided with a locking protrusion passing portion 49 for enabling the groove-shaped locking protrusion 39 to pass through without coming into contact therewith. At this time, in order to secure the thickness of the above-described opening edge portion, a portion of the opening edge portion that is provided with the locking protrusion passing portion 49 protrudes upward more than another portion.

The joint terminal support portions 52 are formed on the wall portion 50 for partitioning two receiving spaces 44*a* that respectively house the stacked connectors 12 that are connected thereto from both sides. Specifically, the joint terminal support portions 52 include a linking piece insertion support portion 53 and a through hole 54.

The linking piece insertion support portion 53 is a portion into which the linking piece 62 of the joint terminal 60 is inserted, and that supports the inserted linking piece 62. Here, the wall portion 50 is provided with two exposure surfaces 51*a* and 51*b*. The two exposure surfaces 51*a* and 51*b* face away from each other. The exposure surfaces 51*a* and 51*b* are exposed to the outside through the receiving spaces 44*a*. Also, one exposure surface 51*a* is provided with a groove 53*a*, as the linking piece insertion support portion 53 that is recessed toward the other exposure surface 51*b*. The width of this groove 53*a* is set to be approximately the same (slightly smaller here) as the thickness of the linking piece 62. Accordingly, the linking piece 62 can be pressed into the groove 53*a*, and thus the linking piece 62 into which the linking piece insertion support portion 53 has been pressed can be supported. A peripheral edge of an opening of the groove 53*a* is an inclined surface 53*b*, and is wide. Accordingly, it is possible to guide the linking piece 62 that is to be inserted.

A plurality of through holes 54 that open into the other exposure surface 51*b* are formed in the bottom of the groove 53*a*. The tab terminals 64 of the joint terminal 60 protrude into another receiving space 44*a* through the through holes 54.

Note that a cassette portion 56 is formed on the lower surface of the joint connector housing 42 that faces away from the upper surface thereof provided with the locking receiving portions 45. Accordingly, it is possible to attach the joint connector housing 42 to a cassette support portion formed on a panel of a vehicle body, for example. Naturally, a configuration in which the joint connector housing 42 is provided with the cassette portion 56 is not an essential configuration, and the cassette portion 56 need not be formed.

The joint terminal 60 is a member for shorting a plurality of terminals 20 in the stacked connectors 12 in a state in which the stacked connectors 12 and the joint connector 40 are fitted to each other. The joint terminal 60 is formed by pressing a flat plate made of a conductive material such as metal. The joint terminal 60 includes a linking piece 62 and a plurality of tab terminals 64 that are arranged in parallel to each other and protrude from the linking piece 62. The linking piece 62 is inserted into and supported by the above-described linking piece insertion support portion 53. Here, twelve tab terminals 64*a* protrude from one longer linking piece 62 on one side, and twelve tab terminals 64*b* also protrude therefrom on the other side. Six of the twelve tab terminals 64*a* on one side that are located closer to the end portion than the center thereof are connected to one stacked connector 12. The same applies to the twelve tab terminals 64*b* on the other side. Here, the tab terminals 64*b* on the other side are formed longer, and protrude into the receiving space 44*a* on the other side through the through holes 29. Here, one joint terminal 60 can short twenty four terminal-equipped electric wires 15 included in one layer. Also, three joint terminals 60 are provided, and the terminal-equipped electric wires 15 included in layers are shorted by the joint terminals 60 disposed in the layers.

As described above, here, twenty four terminal-equipped electric wires 15 included in one layer are shorted. Thus, one or more terminal-equipped electric wires 15 in one of the two stacked connectors 12 that are connected to the joint connector 40 from one side and are adjacent to each other and one or more terminal-equipped electric wires 15 in the other stacked connector 12 are shorted. Also, one or more terminal-equipped electric wires 15 in one of the two stacked connectors 12 that are connected to the joint connector 40 from both sides, and one or more terminal-equipped electric wires 15 in the other stacked connector 12 are shorted. At this time, one or more terminal-equipped electric wires 15 in two of the four stacked connectors 12 that are located in an oblique positional relationship are also shorted.

Naturally, the type of terminal-equipped electric wires 15 shorted by the joint terminal 60 is not limited thereto. For example, the joint terminal 60 may also be capable of shorting terminal-equipped electric wires 15 in a plurality of groups (three groups in the example indicated by vertical lines in FIG. 10) that are different from each other in one layer, as a result of the joint terminal 60 being cut at positions of the virtual lines (line-double dashed lines) shown in FIG. 10.

Manufacturing Examples

Figure 12:
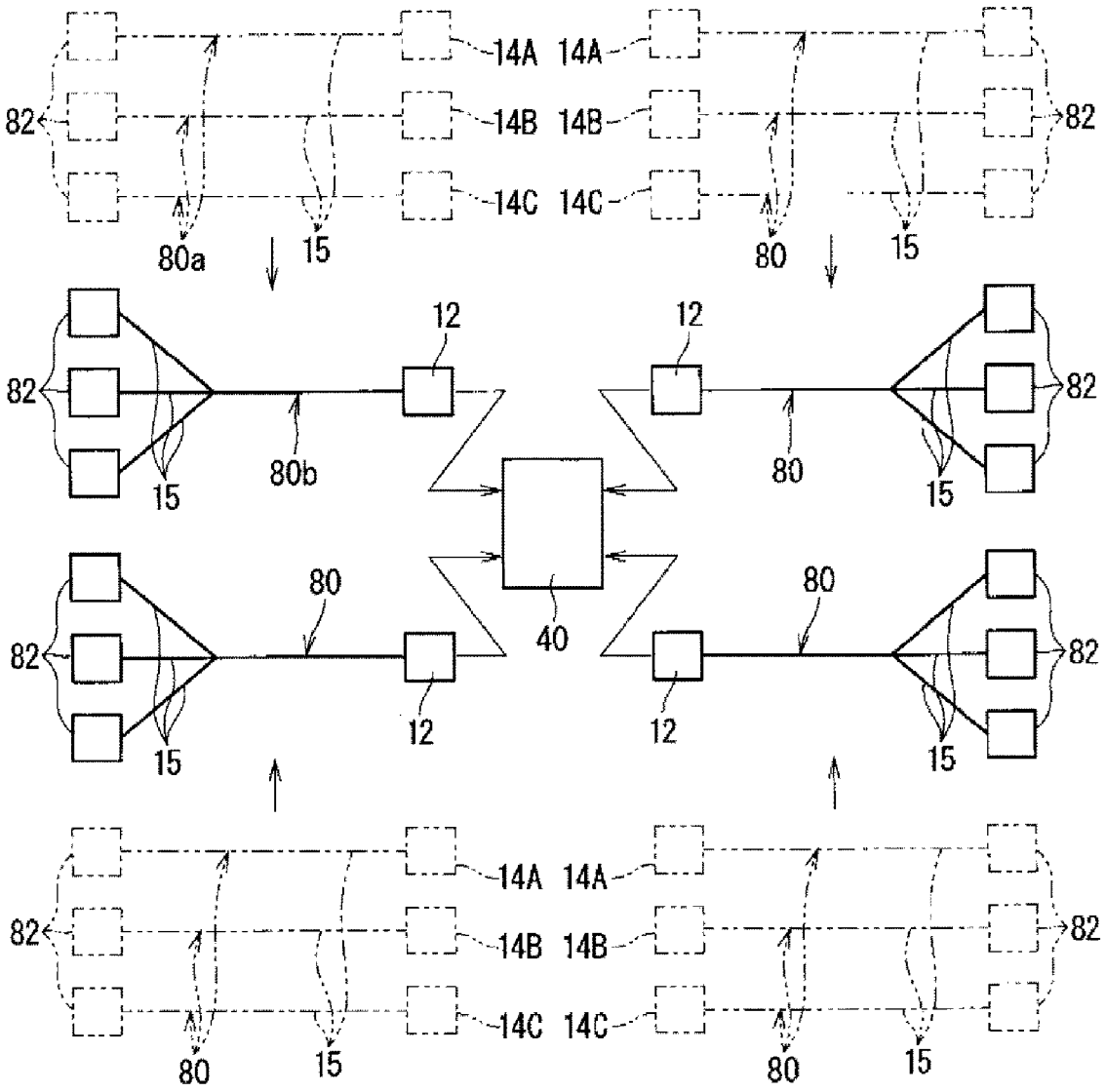
FIG. 12 is a diagram illustrating one manufacturing example of a wire harness.

One manufacturing example of the wire harness 10 including the above-described stacked connectors 12 and the joint connector 40 will be described. FIG. 12 is a diagram illustrating one manufacturing example of the wire harness 10.

For example, as one method for manufacturing the wire harness 10, a plurality of sub-harnesses 80 obtained by splitting the wire harness 10, which is to be the finished product, into several circuits are temporarily manufactured, and these sub-harnesses 80 are assembled. The sub-harnesses 80 can be manufactured relatively easily because the number of circuits is smaller than that of the finished product. Also, even if different types of wire harnesses are manufactured, some sub-harnesses 80 can be used as shared components. Thus, in some cases, the wire harness 10 can be manufactured relatively more easily by way of a plurality of sub-harnesses 80 than in a case where the wire harness 10, which is to be the finished product, is directly manufactured.

However, in a case where the number of poles in one joint connector 40 is increased, if the wire harness 10, which is to be the finished product, is split into a plurality of sub-harnesses 80 in units that are smaller than the joint connector 40 or units of connectors connected thereto, there is a risk that a post-insertion terminal will be formed. Here, a "post-insertion terminal" refers to a terminal that is not connected to a connector at the time of manufacturing sub-harnesses 80 and is connected to a connector at the time of assembling a plurality of sub-harnesses 80. If a post-insertion terminal is present, work for inserting the post-insertion terminal into a connector in a separate process, work for separately providing a cover for protecting the post-insertion terminal until the post-insertion terminal is inserted into a connector, and the like are required.

In contrast, here, because the stacked connectors 12 are adopted, even if the wire harness 10, which is to be the finished product, is split into a plurality of sub-harnesses 80 in units of split connectors 14 of the stacked connector 12, no post-insertion terminal 20 is present. Specifically, here, it is possible to connect two stacked connectors 12 to the joint connector 40 from one side, and thus to make the split connectors 14 smaller. Here, as described above, four stacked connectors 12 that are each constituted by three layers of split connectors 14 are connected to one joint connector 40. Thus, as shown in FIG. 12, even if the wire harness 10 is split into twelve sub-harnesses 80 at the maximum, it is possible to prevent formation of a post-insertion terminal. Thus, the above-described problems resulting from a case where a post-insertion terminal is formed are unlikely to arise, and the wire harness 10 can be more easily manufactured by way of sub-harnesses 80. Note that, although the sub-harnesses 80 are illustrated using a simplified configuration in which one end is provided with the split connectors 14 and the other end is provided with other connectors 82 in the example shown in FIG. 12, the circuit configuration of the sub-harnesses 80 is not limited thereto. The sub-harnesses 80 may also be branched as appropriate, or an earth terminal or the like may be connected to the other end, instead of the connectors 82, for example. Also, although one terminal-equipped electric wire 15 is depicted between the split connector 14 and the connector 82, a plurality of terminal-equipped electric wires 15 may also be used therebetween.

Also, because the upper connector housing 24A, the middle connector housing 24B, and the lower connector housing 24C can be easily joined, it is possible to easily manufacture the sub-harnesses 80*b*, which are relatively larger units, in which the stacked connector 12 is formed by joining the split connectors 14 to each other, from the sub-harnesses 80*a* that have been split into the split connectors 14 and are relatively smaller units.

According to the above-described configuration, because the stacked connectors 12 are adopted, the connectors can be dispersed as a result of the stacked connectors 12 having a split form at the time of manufacture. Also, the connectors can be concentrated as a result of the stacked connectors 12 having a stacked form at the time of arrangement in a vehicle. At this time, the second terminal locking portion 28 is capable of locking the terminal-equipped electric wire 15 received in a joining counterpart, and thus it is possible to reduce the size of the stacked connector 12. Accordingly, it is possible to reduce a space in a vehicle in which the wire harness 10 including a plurality of splice circuits is arranged and achieve good manufacturability at the time of manufacture.

Also, it is possible to connect the plurality of stacked connectors 12 that have been manufactured separately to one joint connector 40, side-by-side. Accordingly, it is possible to suppress a decrease in the number of connectors while making connectors more concentrated. Also, it is possible to disperse connectors at the time of manufacture and make connectors more concentrated at the time of arrangement in a vehicle. Accordingly, it is also possible to reduce a space in a vehicle in which the wire harness 10 including a plurality of splice circuits is arranged and achieve good manufacturability at the time of manufacture. At this time, the connector housings of a plurality of stacked connectors 12 connected from one side are received in one receiving space 44*a*. Thus, walls for partitioning the plurality of stacked connectors 12 are omitted, and thus it is possible to reduce the external size of the joint connector housing 42.

Also, two surfaces of the middle connector housing 24B located at an intermediate position in the stacking direction are provided with the second terminal locking portions 28, and thus the terminal-equipped electric wires 15 in each layer can be locked by the second terminal locking portions 28 even if the split connector housings 24 are stacked in three or more layers.

Also, the upper connector housing 24A is provided with the second terminal locking portions 28 and the through holes 29 in an alternating manner, and the upper surface of the middle connector housing 24B is provided with the second terminal locking portions 28 and the through holes 29 in an alternating manner, and thus the terminal-equipped electric wires 15 of the two counterpart split connectors 14 can be locked by the second terminal locking portions 28.

Also, it is possible to suppress erroneous fitting between the joint connector 40 and the plurality of stacked connectors 12 due to the erroneous fitting restricting ribs 38 being formed.

Also, shared components can be used as the middle connector housing 24B and the lower connector housing 24C in the plurality of stacked connectors 12, and thus it is possible to suppress an increase in the number of types of components.

Also, a plurality of stacked connectors 12 are connected to one joint connector 40 from both sides, and thus it is possible to suppress a decrease in the number of connectors while making the connectors more concentrated.

Variations

Figure 13:
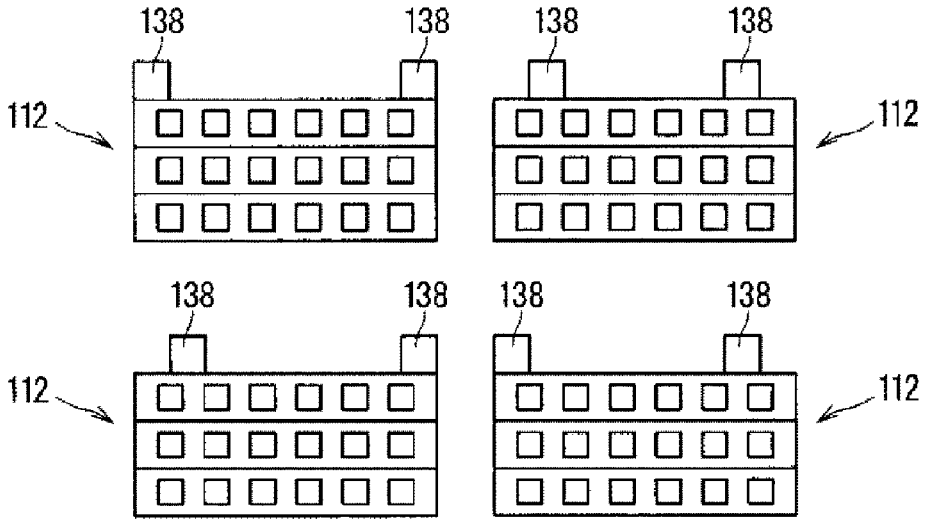
FIG. 13 is a diagram illustrating a variation of a stacked connector.

Although an embodiment has been described in which two stacked connectors 12 that are provided with the erroneous fitting restricting ribs 38 and are connected from one side are distinguished, this configuration is not an essential configuration. The erroneous fitting restricting ribs 38 need not be provided. Also, if the erroneous fitting restricting ribs 38 are provided, the erroneous fitting restricting ribs 38 may be formed such that all the stacked connectors 12 to be connected to one joint connector 40 can be distinguished. FIG. 13 is a diagram illustrating a variation of the stacked connector 12. Similarly to the stacked connector 12 according to the embodiment, two erroneous fitting restricting ribs 138 are provided on one stacked connector 112 according to a variation. However, in the stacked connectors 112, the positions of the two erroneous fitting restricting ribs 138 provided on one stacked connector 112 are respectively disposed selectively at two positions in the width direction, and thus four stacked connectors 112 can be distinguished.

In addition, although an embodiment in which the locking receiving portions 45 of the joint connector housing 42 are formed in a cantilever shape has been described, this configuration is not an essential configuration. For example, in an embodiment, a locking protrusion passing portion 49 may be formed and the opening edge portion of the receiving space 44*a* of the joint connector housing 42 may function as the locking receiving portion 45. In this case, a configuration is conceivable in which a through hole that is the same as the above-described second through hole 48 in which the locking protrusion 39 is received is formed inward of the opening edge portion and adjacent to the opening edge portion.

Also, although an embodiment in which the plurality of stacked connectors 12 are connected to one joint connector 40 was described, this configuration is not an essential configuration. A configuration may be adopted in which one stacked connector 12 is connected to one joint connector. Also, a configuration in which a plurality of the stacked connectors 12 are connected to one joint connector 40, a configuration in which a plurality of the stacked connectors 12 are connected to one side of one joint connector 40, or a configuration in which a plurality of the stacked connectors 12 are connected to both sides of one joint connector 40 may be adopted.

Note that configurations described in the above-described embodiments and variations can be combined as appropriate as long as no contradiction arises therein.

Although this invention has been described in detail above, the above description is illustrative in all aspects, and this invention is not limited thereto. It will be understood that numerous modifications not illustrated here can be envisioned without departing from the scope of this invention.

LIST OF REFERENCE NUMERALS

10 Wire harness
12 Stacked connector
14 Split connector
14A Upper connector
14B Middle connector
14C Lower connector
15 Terminal-equipped electric wire
16 Electric wire
20 Terminal
21 Electric wire connection portion
22 Counterpart connection portion
24 Split connector housing
24A Upper connector housing
24B Middle connector housing
24C Lower connector housing
25 Terminal receiving chamber
26 Insertion hole
27 First terminal locking portion
28 Second terminal locking portion
29 Through hole
38 Erroneous fitting restricting rib
39 Locking protrusion
40 Joint connector
42 Joint connector housing
43 Housing receiving portion
44*a* Receiving space
45 Locking receiving portion
46 Locking receiving piece
52 Joint terminal support portion
60 Joint terminal
62 Linking piece
64 Tab terminal
80 Sub-harness
82 Connector

The invention claimed is:

1. A wire harness comprising:

a stacked connector formed by joining a plurality of split connectors to each other, in which the split connectors each include: a split connector housing provided with a plurality of terminal receiving chambers; and a plurality of terminal-equipped electric wires that each include a terminal received in the terminal receiving chamber and an electric wire to which the terminal is connected, and at least one of the split connector housings is provided with a locking portion having a protruding shape that protrudes outward to be capable of locking the terminal-equipped electric wire received in the split connector housing of a joining counterpart; and a joint connector that includes a joint terminal provided with a linking piece and a plurality of tab terminals protruding in parallel to each other from the linking piece, and a joint connector housing in which the joint terminal is housed and by which the joint terminal is supported, the joint connector being capable of being fitted to the stacked connector, wherein the split connector housing located in one surface layer of the stacked connector is provided with a locking protrusion, the joint connector housing is provided with a locking receiving portion that is formed to deform elastically more easily than the locking protrusion, the locking protrusion being inserted into and locked to the locking receiving portion, the locking receiving portion is cantilevered in a direction opposite to a direction in which the locking protrusion is inserted to the locking receiving portion from an inner portion of the locking receiving portion, and a first plurality of the stacked connectors are connected to the joint connector from a front side of the joint connector, and a second plurality of the stacked connectors are connected to the joint connector from a rear side of the joint connector.

2. A wire harness comprising:

a stacked connector formed by joining a plurality of split connectors to each other, in which the split connectors each include: a split connector housing provided with a plurality of terminal receiving chambers; and a plurality of terminal-equipped electric wires that each include a terminal received in the terminal receiving chamber and an electric wire to which the terminal is connected, and at least one of the split connector housings is provided with a locking portion having a protruding shape that protrudes outward to be capable of locking the terminal-equipped electric wire received in the split connector housing of a joining counterpart; and a joint connector that includes a joint terminal provided with a linking piece and a plurality of tab terminals protruding in parallel to each other from the linking piece, and a joint connector housing in which the joint terminal is housed and by which the joint terminal is supported, the joint connector being capable of being fitted to the stacked connector, wherein a plurality of the stacked connectors are connected to one joint connector, the split connector housing located in one surface layer of each of the plurality of stacked connectors is provided with erroneous fitting restricting ribs having different shapes, the erroneous fitting restricting ribs are protruded upwardly from an upper surface of the split connector housing, and a first plurality of the stacked connectors is connected to the one joint connector from a front side of the one joint connector, and a second plurality of the stacked connectors is connected to the one joint connector from a rear side of the joint connector.

3. The wire harness according to claim 2, wherein the split connector housings located in layers other than the one surface layer of each of the plurality of stacked connectors are formed in the same shape.

4. A wire harness comprising:

a stacked connector formed by joining a plurality of split connectors to each other, in which the split connectors each include: a split connector housing provided with a plurality of terminal receiving chambers; and a plurality of terminal-equipped electric wires that each include a terminal received in the terminal receiving chamber and an electric wire to which the terminal is connected, and at least one of the split connector housings is provided with a locking portion having a protruding shape that protrudes outward to be capable of locking the terminal-equipped electric wire received in the split connector housing of a joining counterpart; and a joint connector that includes a joint terminal provided with a linking piece and a plurality of tab terminals protruding in parallel to each other from the linking piece, and a joint connector housing in which the joint terminal is housed and by which the joint terminal is supported, the joint connector being capable of being fitted to the stacked connector, wherein a plurality of the stacked connectors are connected side-by-side to the one joint connector from one of a front side and a rear side of the one joint connector that are opposite to each other and at which receiving spaces are respectively provided, the joint connector housing is capable of receiving, in one of the receiving spaces, connector housings of the plurality of the stacked connectors to be connected to the joint connector housing from one of the front side and the rear side of the one joint connector, and a first plurality of the stacked connectors is connected to the one joint connector from the front side of the one joint connector, and a second plurality of the stacked connectors is connected to the one joint connector from the rear side of the one joint connector.

* * * * *